US011152722B2

(12) United States Patent
Hung

(10) Patent No.: US 11,152,722 B2
(45) Date of Patent: Oct. 19, 2021

(54) TERMINAL PIN AND ELECTRICAL CONNECTOR THEREOF

(71) Applicant: Dongguan Luxshare Technologies Co., Ltd, Dongguan (CN)

(72) Inventor: Yung-Chih Hung, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 67 days.

(21) Appl. No.: 16/789,213

(22) Filed: Feb. 12, 2020

(65) Prior Publication Data

US 2021/0126386 A1 Apr. 29, 2021

(30) Foreign Application Priority Data

Oct. 24, 2019 (TW) ..... 108138495

(51) Int. Cl.
*H01R 11/11* (2006.01)
*H01R 25/00* (2006.01)
*H01R 13/04* (2006.01)

(52) U.S. Cl.
CPC ..... *H01R 11/11* (2013.01); *H01R 13/04* (2013.01); *H01R 25/003* (2013.01)

(58) Field of Classification Search
CPC ..... H01R 11/11; H01R 13/04; H01R 25/003; H01R 13/432; H01R 13/113
See application file for complete search history.

(56) References Cited

U.S. PATENT DOCUMENTS

| | | | | |
|---|---|---|---|---|
| 5,458,511 | A | 10/1995 | Sasai et al. | |
| 5,695,368 | A * | 12/1997 | Joly | H01R 13/432 439/748 |
| 5,971,816 | A * | 10/1999 | Chaillot | H01R 13/113 439/852 |
| 6,165,026 | A * | 12/2000 | Sugie | H01R 13/432 439/746 |
| 6,183,312 | B1 * | 2/2001 | Yamamoto | H01R 13/432 439/746 |
| 6,267,616 | B1 * | 7/2001 | Sakatani | H01R 13/432 439/397 |
| 7,303,447 | B1 * | 12/2007 | Tyler | H01R 13/432 439/746 |
| 2001/0019925 | A1 * | 9/2001 | Heimueller | H01R 13/113 439/851 |
| 2003/0119383 | A1 | 6/2003 | Sai et al. | |

FOREIGN PATENT DOCUMENTS

TW I575815 B 3/2017

* cited by examiner

*Primary Examiner* — Tho D Ta
(74) *Attorney, Agent, or Firm* — Birch, Stewart, Kolasch & Birch, LLP

(57) ABSTRACT

A terminal pin includes a pin body and an elastic latch. The pin body has a first end and a second end. The elastic latch is connected to the pin body and normally protrudes from the pin body with a stopping tip extending toward the second end. An electrical connector is also provided, which includes a base and the terminal pin. The base includes an accommodating aperture defined through the base. A notch is formed in the accommodating aperture and recessed from an inner wall of the accommodating aperture. The notch includes a stopping surface. The terminal pin is inserted into the accommodating aperture with the stopping tip of the elastic latch abutted against the stopping surface.

12 Claims, 11 Drawing Sheets

TERMINAL PIN AND ELECTRICAL CONNECTOR THEREOF

CROSS-REFERENCE TO RELATED APPLICATION

This non-provisional application claims priority under 35 U.S.C. § 119(a) to patent application No. 108138495 in Taiwan, R.O.C. on Oct. 24, 2019, the entire contents of which are hereby incorporated by reference.

BACKGROUND

Technical Field

This disclosure relates to a terminal pin and an electrical connector, in particular, to a terminal pin and an electrical connector including the terminal pin.

Related Art

An electrical connector, for example a connector on a circuit board for power or signal transmissions, generally includes an electrical-insulated base and plural terminal pins. The base has plural through holes aligned parallel and defined through the front side surface and the rear side surface of the base. The terminal pins are respectively inserted into the through holes, and leads are exposed from the rear side surface for soldering or electrical connection.

SUMMARY

In general, the base of the electrical connector is formed by injection molding with plastic materials. As a result, complicated structures for positioning the terminal pins cannot be provided in the through holes. Hence, when the connector is inserted into or detached from a mating connector, the terminal pins suffer the stress for being detached off the connector. To solve the positioning problem for the terminal pins, in an electrical connector known to the inventor, an external fixing pin is inserted into one side surface of the base to hold or stop the terminal pins. However, the external fixing pin is small and cannot be assembled in the electrical connector easily, thereby affecting the production yield of the electrical connector. Moreover, the insertion of the external fixing pin into the electrical connector may cause assembling fail issues, thereby producing defective products. Furthermore, if the insertion hole of the fixing pin is located at the front surface of the electrical connector, the user may mistakenly take the insertion hole of the external pin as a receiving opening for an external terminal pin, and the user would then insert the external terminal pin into the insertion hole of the pin, thereby causing damage to the external terminal pin or to the electrical connector.

In order to solve the positioning problem of the terminal pins in the electrical connector, this disclosure discloses a terminal pin and an electrical connector, so that the terminal pins can be positioned effectively and can be assembled easily.

A terminal pin according to this disclosure comprises a pin body and an elastic latch. The pin body includes a first end and a second end. The elastic latch is connected to the pin body and normally protrudes from the pin body with a stopping tip extending toward the second end.

In at least one embodiment, a hollow space is defined within the pin body.

In at least one embodiment, the pin body includes an elastic clamping member, disposed at the first end.

In at least one embodiment, the elastic clamping member comprises at least one elastic piece. The at least one elastic piece is connected to the pin body and protrudes to the hollow space.

In at least one embodiment, a concave portion is formed on one side of the pin body.

In at least one embodiment, a fixed end of the elastic latch is configured across the concave portion, so that the elastic latch is located above the concave portion.

In at least one embodiment, the pin body includes a fixed portion disposed at the second end.

An electrical connector according to this disclosure comprises a base and a terminal pin. The base includes an accommodating aperture defined through the base to form a receiving opening and an insertion opening on the base. A notch is formed in the at least one accommodating aperture and recessed from an inner wall of the at least one accommodating aperture. The notch includes a stopping surface facing toward the receiving opening. The terminal pin includes a pin body and an elastic latch. The pin body includes a first end and a second end. The elastic latch is connected to the pin body and normally protrudes from the pin body with a stopping tip extending toward the second end. The first end of the pin body passes through the insertion opening and is inserted into the at least one accommodating aperture with the stopping tip of the elastic latch abutted against the stopping surface.

In at least one embodiment, a stopping flange is formed at an edge of the receiving opening and extends inwardly along a radial direction of the second accommodating aperture.

In at least one embodiment, a concave portion is formed on one side of the pin body, and a protruding rib is disposed in the accommodating aperture and extending along longitudinal direction of the accommodating aperture, The concave portion is provided for receiving the at least one protruding rib.

In at least one embodiment, a fixed end of the elastic latch is configured across the concave portion, so that the elastic latch is located above the concave portion. The at least one protruding rib corresponds to the notch.

In at least one embodiment, the base includes a first guiding bevel, the receiving opening includes a stepped segment with respect to a surface of the base, and the first guiding bevel connects the surface of the base to the edge of the receiving opening.

In at least one embodiment, the base comprises a base body and a front cover. The base body includes a first side surface and a second side surface opposite to the first side surface. An installation trough is formed on the first side surface. The base body further includes at least one first through hole. The at least one first through hole communicate the second side surface and the installation trough, and the at least one first through hole forms the insertion opening at the second side surface. The front cover includes a front surface and a rear surface. The front cover further includes at least one second through hole communicating the front surface and the rear surface, and forming the receiving opening at the front surface. The front cover is embedded into the installation trough with the rear surface facing the base body, so that the at least one second through hole is connected to the at least one first through hole to form the accommodating aperture.

In at least one embodiment, the base further comprises a second guiding bevel located in the first through hole. The second guiding bevel divides the first through hole into two portions. A pore diameter of one of the two portions of the first through hole near the second side surface is greater than a pore diameter of the other portion of the first through hole near the receiving opening.

In at least one embodiment, the notch is formed on a wall surface of the at least one second through hole, and the stopping surface is a portion of the wall surface of the at least one second through hole.

In at least one embodiment, the notch is formed on a wall surface of the at least one first through hole, and the stopping surface is a portion of the wall surface of the at least one first through hole.

In at least one embodiment, a missing corner is formed at one end the at least one second through hole on the rear surface, the missing corner and a bottom of the installation trough define the notch, and the stopping surface is a portion of the bottom.

In one or more embodiments of this disclosure, the terminal pin includes the elastic latch. The terminal pin can be automatically engaged with the base after being inserted into the base. Therefore, the electrical connector can be devoid of external components, such as fixing pins, which are used for positioning the terminal pin, thereby reducing the assembly time of the electrical connector. In one or more embodiments of this disclosure, the electric connector including the terminal pin is further provided. The electrical connector is provided with base in different structures, and the electrical connector is provided with the notch corresponding to the elastic latch to fix the terminal pin.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
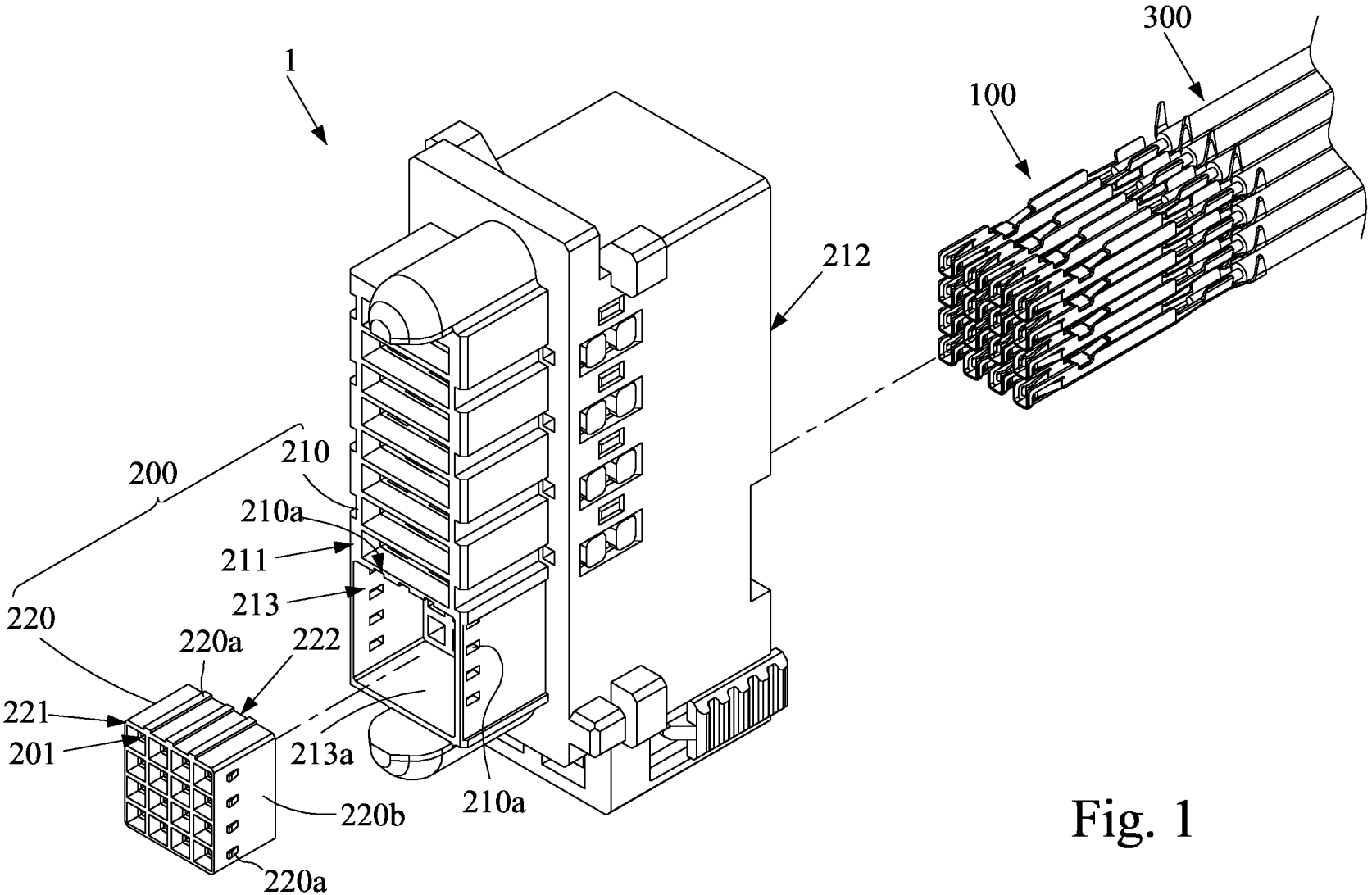
FIG. 1 illustrates an exploded view of an electrical connector according to a first embodiment of this disclosure.
Figure 2:
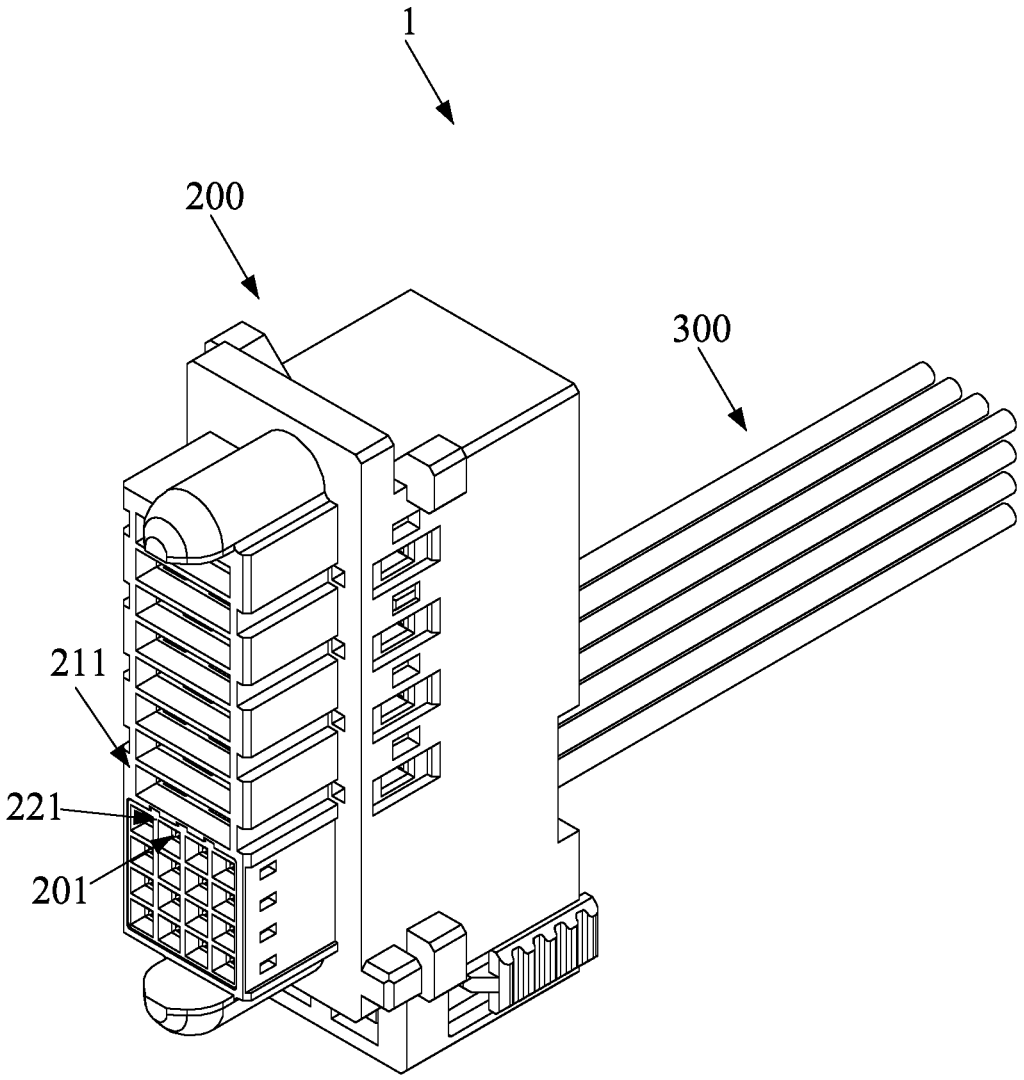
FIG. 2 illustrates a perspective view of the electrical connector of the first embodiment.
Figure 3:
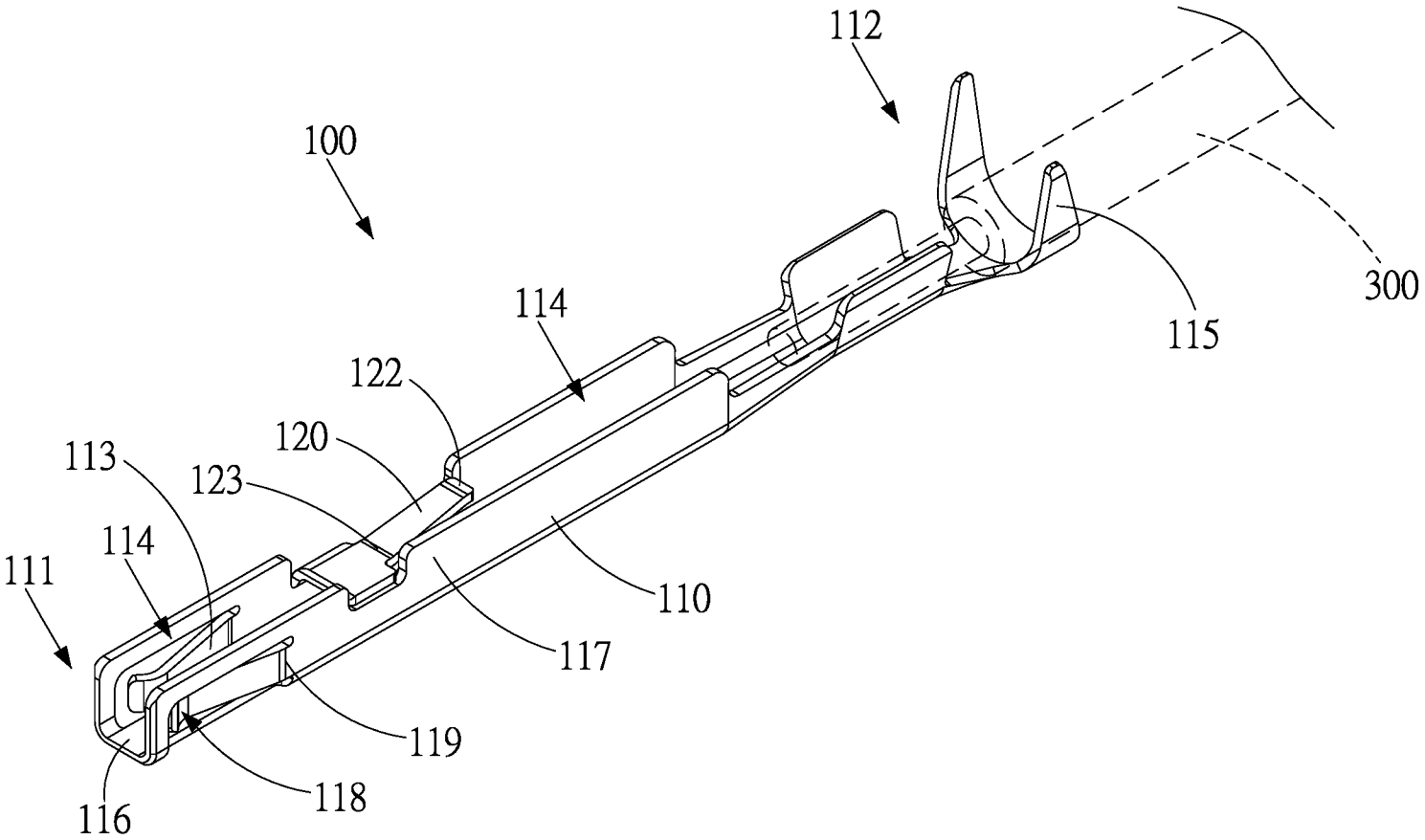
FIG. 3 illustrates a perspective view of a terminal pin of the electrical connector of the first embodiment.

Please refer to FIGS. 1, 2, and 3, a terminal pin 100 according to a first embodiment of this disclosure is illustrated. The terminal pin 100 is adapted to be combined with a base 200 to form an electrical connector 1.

As shown in FIGS. 1 and 3, the terminal pin 100 comprises a pin body 110 and an elastic latch 120. The pin body 110 includes a first end 111 and a second end 112. The elastic latch 120 is connected to the pin body 110 and normally protrudes from the pin body 110 with a stopping tip 122 extending toward the second end 112.

Please refer to FIG. 3 again. Specifically, in one embodiment, the manufacturing process of the terminal pin 100 is applying a stamping process to a metal sheet. The pin body 110 is of a tubular structure or a semi-circle tube structure with one side opened, and an open or half-open hollow space is defined within the pin body 110. In the first embodiment, the pin body 110 is a semi-circle tube structure with one side partially or totally opened. More specific, in this embodiment, the pin body 110 has a bottom wall 116, and two side walls 117. The two side walls 117 are respectively extending upward from two side of the bottom wall 116 to form a structure with a C-shaped or U-shaped cross section, and a half-open hollow space is defined among the bottom wall 116 and two side walls 117. In the other words, a concave portion 114 is formed among the bottom wall 116 and two side walls 117, the concave portion 114 is means the hollow space. A fixed end 123 of the elastic latch 120 is configured across the concave portion 114, so that the elastic latch 120 is located above the concave portion As shown in FIG. 3, the pin body 110 further includes an elastic clamping member 113 disposed at the first end 111 and adapted to clamp an external terminal pin inserted from the first end 111. The elastic clamping member 113 ensures a good contact between the pin body 110 and the external terminal pin, thereby providing good electrical connection performance. The elastic clamping member 113 includes at least one elastic piece. The elastic piece of the elastic clamping member 113 is connected to the pin body 110 and protrudes to the hollow space. More specific, a slot 118 is formed on the side wall 117, one end of the elastic clamping member 113 is connected to a side peripheral wall 119 of the slot 118, and the other end of the elastic clamping member 113 is a free end and protrudes to the concave portion 114 (hollow space). The number of the elastic piece may be two, and the two elastic pieces are correspondingly arranged to include the configuration of a clamping fixture. The number of the elastic piece also may be three or more, so that the elastic pieces can contact the external terminal by multiple directions.

As shown in FIG. 3, the pin body 110 further includes a fixed portion 115. The fixed portion 115 is disposed at the second end 112 and is adapted to clamp a wire 300 connected to the second end 112. For example, the fixed portion 115 may be two extension sheets arranged at the second end 112 and extending toward opposite directions, and the two extension sheets are bent and combined with each other to form a collar configuration; alternatively, the fixing portion 115 can be compressed by a pliers to deform so as to clamp the wire 300.

As mentioned above, specifically, in one embodiment, the manufacturing process of the terminal pin 100 is applying a stamping process to a metal sheet. Therefore, the pin body 110, the elastic latch 120, the elastic clamping member 113, and the fixed portion 115 are integrally formed as a one-piece structure. After stamping and cutting processes are applied to the pin body 110 to form some suitable cutting slots on the pin body 110, portions of the pin body surrounding the cutting slots are bent inwardly or outwardly, so that the elastic latch 120 and the elastic clamping member 113 can be formed. The second end 112 may form two extension sheets extending toward opposite directions through appropriate cutting processes, thereby the two extension sheet can be the fixed portion 115.

Figure 4:
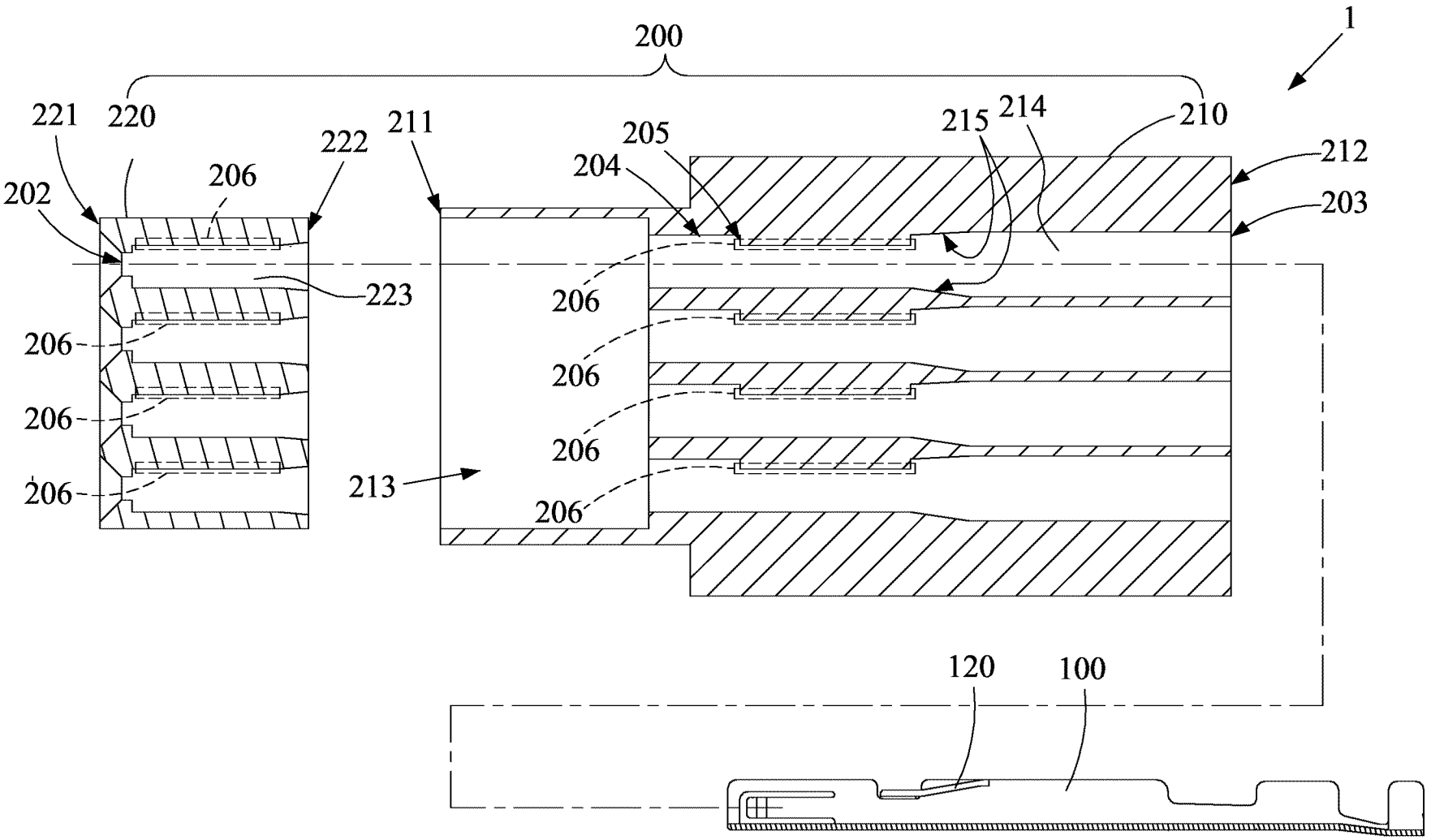
FIG. 4 illustrates an exploded cross-sectional view of the electrical connector of the first embodiment.
Figure 5:
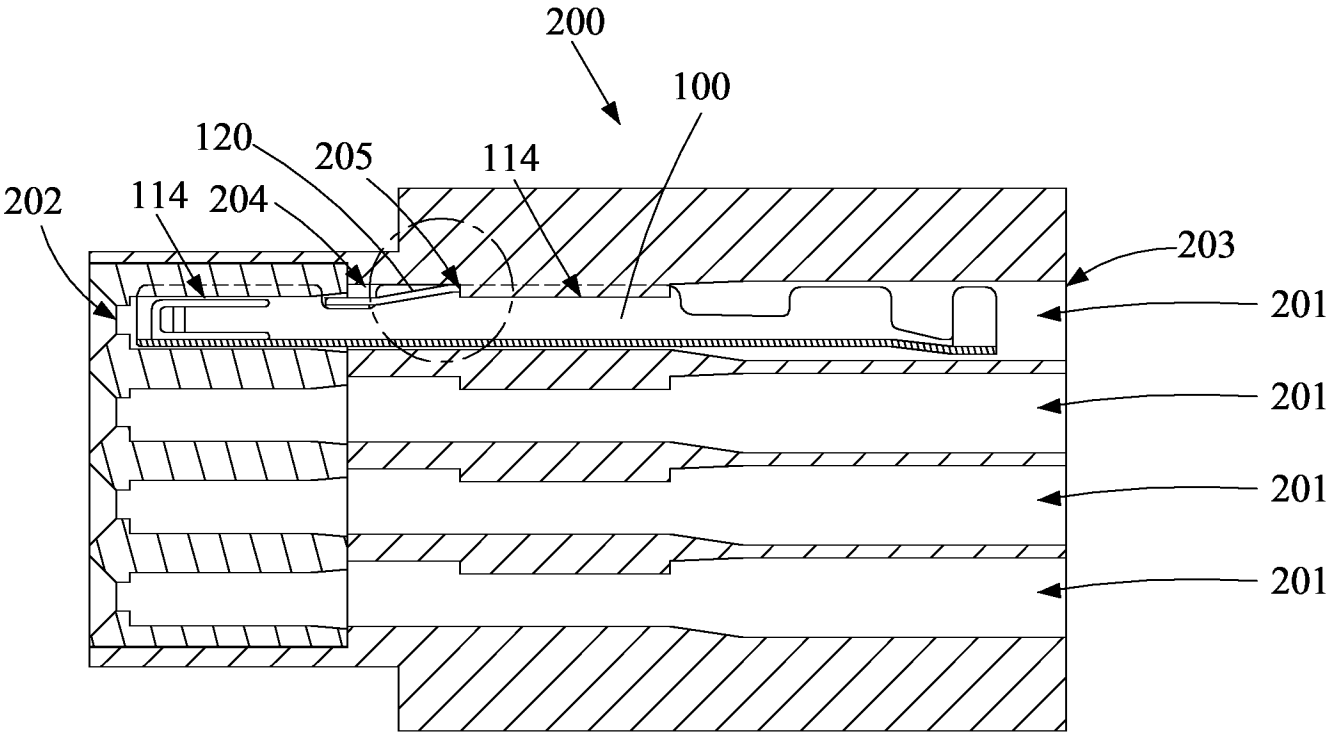
FIG. 5 illustrates a cross-sectional view of the electrical connector of the first embodiment.

As shown in FIGS. 2, 4, and 5, the base 200 includes one or more accommodating apertures 201 for receiving and holding at least a portion of the terminal pin 100. The accommodating aperture 201 is defined through the base 200 to form a receiving opening 202 and an insertion opening 203 on the two opposite side surfaces of the base 200. The first end 111 of the pin body 110 passes through the insertion opening 203 and is inserted into the accommodating aperture 201. The receiving opening 202 is adapted to receive the insertion of the external terminal pin, so that the external terminal pin is able to be connected to the first end 111 of the pin body 110.

Figure 6:
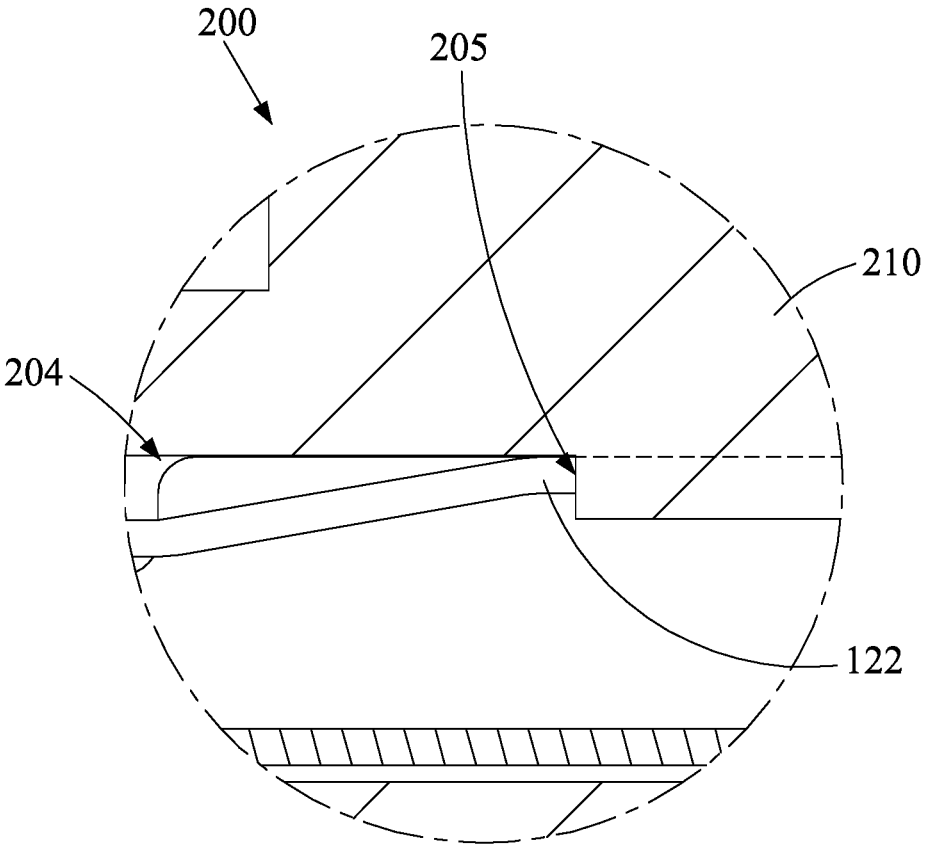
FIG. 6 illustrates a partial cross-sectional view of the electrical connector of the first embodiment.

As shown in FIGS. 4, 5, and 6, a notch 204 is formed in the accommodating aperture 201 and is recessed from an inner wall of the accommodating aperture 201. The notch 204 includes a stopping surface 205 facing toward the receiving opening 202. When the pin body 110 is inserted into the accommodating aperture 201, the elastic latch 120 is first pressed by the inner wall of the accommodating aperture 201 and closely attached on the surface of the pin body 110. When the elastic latch 120 is located in the notch 204, the elastic latch 120 recovers to a protruding configuration with the stopping tip 122 abutted against the stopping surface 205. At this time, the pin body 110 is fixed and cannot be pulled out from the accommodating aperture 201, thereby achieving the fixation of the terminal pin 100.

Figure 7:
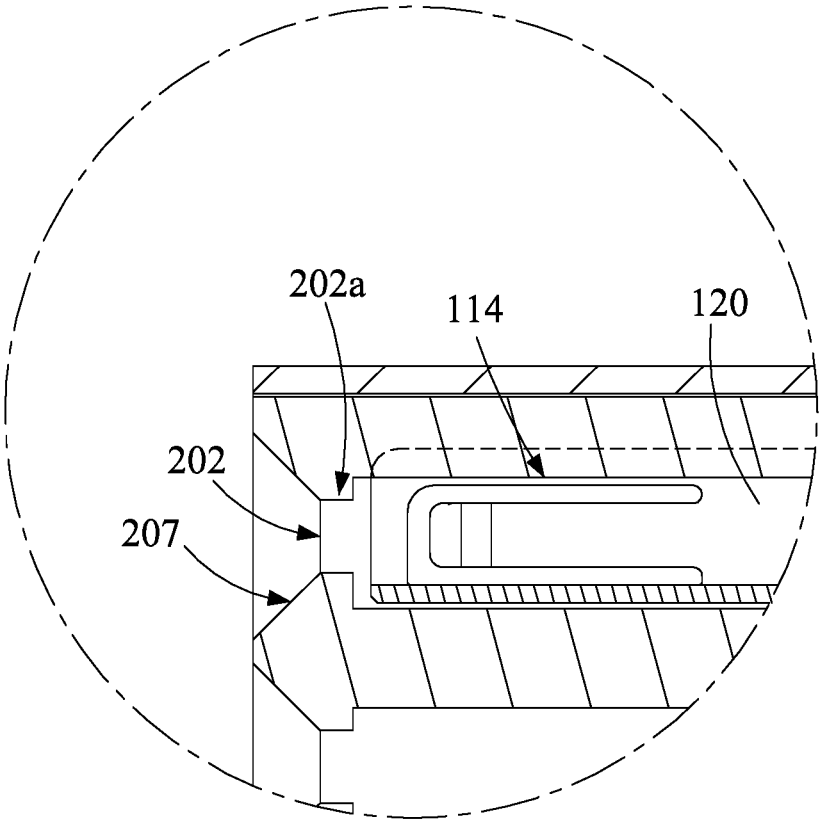
FIG. 7 illustrates another partial cross-sectional view of the electrical connector of the first embodiment.

As shown in FIG. 7, a stopping flange 202*a* is formed at an edge of the receiving opening 202 extending inwardly along a radical direction of the second accommodating aperture 201. The stopping flange 202*a* may be a portion protruding from the edge of the receiving opening 202 or may be a structure annularly protruding from the edge of the receiving opening 202. Therefore, a cross-sectional area of the receiving opening 202 is smaller than the sectional areas of the other portions of the accommodating aperture 201. The stopping flange 202*a* is adapted to be abutted against the first end 111 of the pin body 110, thereby avoiding the pin body 110 from detaching off the receiving opening 202. Therefore, the terminal pin 100 can be fixed in the accommodating aperture 201 through using the stopping flange 202*a* stopping the first end 111 of the pin body 110 and using the stopping tip 122 abutted against the stopping surface 205, thereby additional external fixing pins can be devoid for the fixation of the terminal pin 100.

Figure 9:
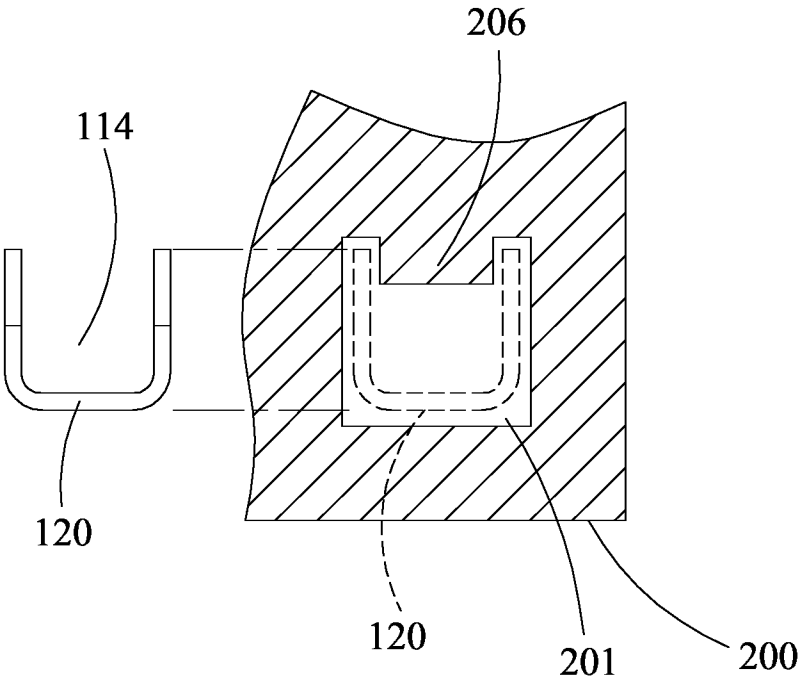
FIG. 9 illustrates a partial exploded cross-sectional view of the base and the terminal pin of the electrical connector of the first embodiment.
Figure 8:
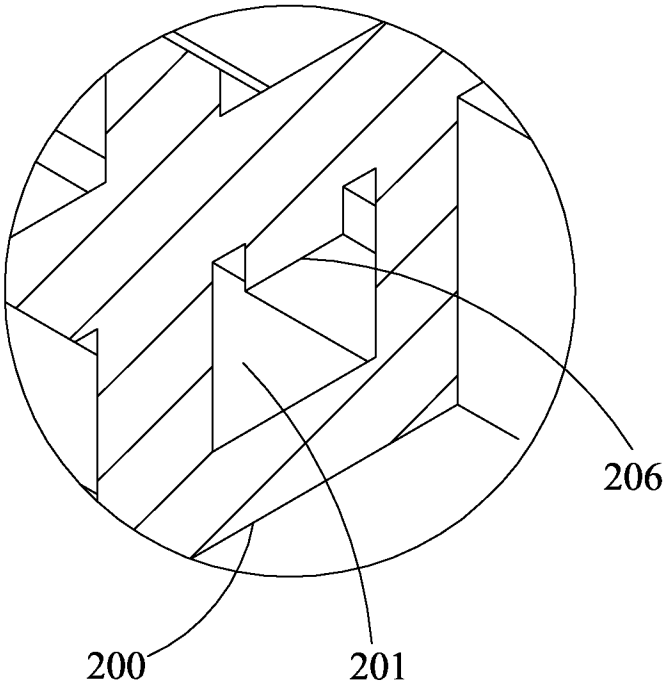
FIG. 8 illustrates a partial cross-sectional view of a base of the electrical connector of the first embodiment.

As shown in FIGS. 4, 8, and 9, to ensure that the elastic latch 120 can be aligned with the notch 204, a protruding rib 206 is in the accommodating aperture 201 and extending along a longitudinal direction of the accommodating aperture 201. The protruding rib 206 can be continuously extending from the receiving opening 202 to the insertion opening 203; alternatively, the protruding rib 206 may also include a discontinuous configuration.

As mentioned above, the pin body 110 is a semi-circle tube structure with one side partially or totally opened, and the concave portion 114 is formed on one side of the pin body 110. The concave portion 114 is provided for receiving the protruding rib 206. The relative positions of the concave portion 114 and the elastic latch 120 are configured according to following descriptions. When the pin body 110 is in the accommodating aperture 201 and the protruding rib 206 is received in the concave portion 114, the elastic latch 120 is just located at the notch 204. Therefore, when the pin body 110 is inserted into the accommodating aperture 201 from the insertion opening 203, the concave portion 114 is to be aligned with the protruding rib 206, so that the pin body 110 can be inserted into the accommodating aperture 201. When the concave portion 114 is aligned with the protruding rib 206, the elastic latch 120 can reach the notch 204 along with the forward movement of the pin body 110.

Furthermore, as shown in FIG. 7, the base 200 further includes a first guiding bevel 207 connected to the edge of the receiving opening 202. The receiving opening 202 includes a stepped segment with respect to a surface of the base 200, and the first guiding bevel 207 connects the surface of the base 200 to the edge of the receiving opening 202. The first guiding bevel 207 may be a single conical surface or may be formed by plural planes, so that a tapped cone hole can be formed on the surface of the base 200 and connected to the edge of the receiving opening 202. The first guiding bevel 207 is provided for guiding an external terminal pin to enter into the receiving opening 202. Hence, the external terminal pin is not required to be precisely aligned with the receiving opening 202 having a relative smaller pore size.

Please refer to FIGS. 1 and 4, the base 200 according to the first embodiment further comprises a base body 210 and a front cover 220. In general, the base body 210 and the front cover 220 are made of electrical-insulated materials. Specifically, in one embodiment, the base body 210 and the front cover 220 are made of plastic materials and manufactured by injection molding techniques.

As shown in FIGS. 1 and 4, the base body 210 includes a first side surface 211 and a second side surface 212 opposite to the first side surface 211. In this embodiment, the first side surface 211 and the second side surface 212 are portions of the surface of the base 200. An installation trough 213 is formed on the first side surface 211. The installation trough 213 may cover the entire first side surface 211, or may just occupy a portion of the first side surface 211. The base body 210 further includes one or more first through holes 214. The first through hole 214 communicates the second side surface 212 and the installation trough 213. The opening of the first through hole 214 at the second side surface 212 is the insertion opening 203. That is, the first through hole 214 forms the insertion opening 203 at the second side surface 212. An inner wall surface 213*a* of the installation trough 213 may be a single continuous curved surface or may be a surface formed by connecting plural planes. In a second embodiment, the inner wall surface 213*a* includes plural planes connected sequentially to form the inner wall surface 213*a*.

As shown in FIG. 4, the base 200 further includes a second guiding bevel 215 located in the first through hole 214. The second guiding bevel 215 may be a single conical surface or may be formed by plural planes. The second guiding bevel 215 divides the first through hole 214 into two sections. A pore diameter of one of the two portions of the first through hole 214 near the second side surface 212 is greater than a pore diameter of the other portion of the first through hole 214 near the first side surface 211. Therefore, the terminal pin 100 can be inserted into the first through hole 214 easily from the second side surface 212, while the terminal pin 100 can be properly limited by the first through hole 214 without excessive lateral deflection movements. The second guiding bevel 215 is not necessarily located at a middle portion of the first through hole 214 as shown in FIG. 4, the second guiding bevel 215 also may be located at the opening of the first through hole 214 at the second side surface 212, as long as the second guiding bevel 215 faces toward the second side surface 212, and the pore diameter of one of the two portions of the first through hole 214 near the second side surface 212 is greater than the pore diameter of the other portion of the first through hole 214 near the first side surface 211.

As shown in FIGS. 1 and 4, the front cover 220 includes a front surface 221 and a rear surface 222. The front cover 220 further includes one or more second through holes 223. The second through hole 223 communicates the front surface 221 and the rear surface 222, and forms the receiving opening 202 at the front surface 221.

As shown in FIGS. 1, 2, 4, and 5, an outer wall surface 220*b* of the front cover 220 is matched with the inner wall surface 213*a* of the installation trough 213. Hence, the front cover 220 is embedded into the installation trough 213 with the rear surface 222 facing the base body 210, so that the front surface 221 becomes a portion of the surface of the base 200. At the same time, the first through hole 214 is connected to the second through hole 223 to form the accommodating aperture 201.

As shown in FIGS. 4, 5 and 6, in the first embodiment, the notch 204 is formed at the wall surface of the first through hole 214, so that the stopping surface 205 becomes a portion of the wall surface of the first through hole 214. The position of the elastic latch 120 corresponds to the position of the notch 204. Therefore, when the first end 111 of the pin body 110 is abutted against the stopping flange 202*a* at the edge of the insertion opening 203, the elastic latch 120 can be just exactly engaged into the notch 204. The protruding rib 206 mentioned above can be continuously extending from the first through hole 214 to the second through hole 223; alternatively, the protruding rib 206 can be discontinuously configured in the first through hole 214 and the second through hole 223 respectively, or the protruding rib 206 can be configured just in the first through hole 214 or in the second through hole 223. Because the elastic latch 120 is located above the concave portion 114, the protruding rib 206 and the notch 204 are configured correspondingly.

As shown in FIG. 1, one or more first positioning members 210*a* are disposed on the inner wall surface 213*a* of the installation trough 213. One or more second positioning members 220*a* are disposed on the outer wall surface 220*b* of the front cover 220. The second positioning member 220*a* is provided for combining with the first positioning member 210*a*, so that the assembly direction of the front cover 220 can be limited. Thus, the first through hole 214 can be properly aligned with and connected to the second through hole 223, thereby ensuring the relative position of the notch 204 being correct. The first positioning members 210*a* and the second positioning member 220*a* are a combination of a protruding portion and a recessed portion; the configurations are not limited thereto, as long as the first positioning member 210*a* can combine with the second positioning member 220*a*. Two different combinations of the protruding portions and the recessed portions are illustrated in FIG. 1.

Figure 10:
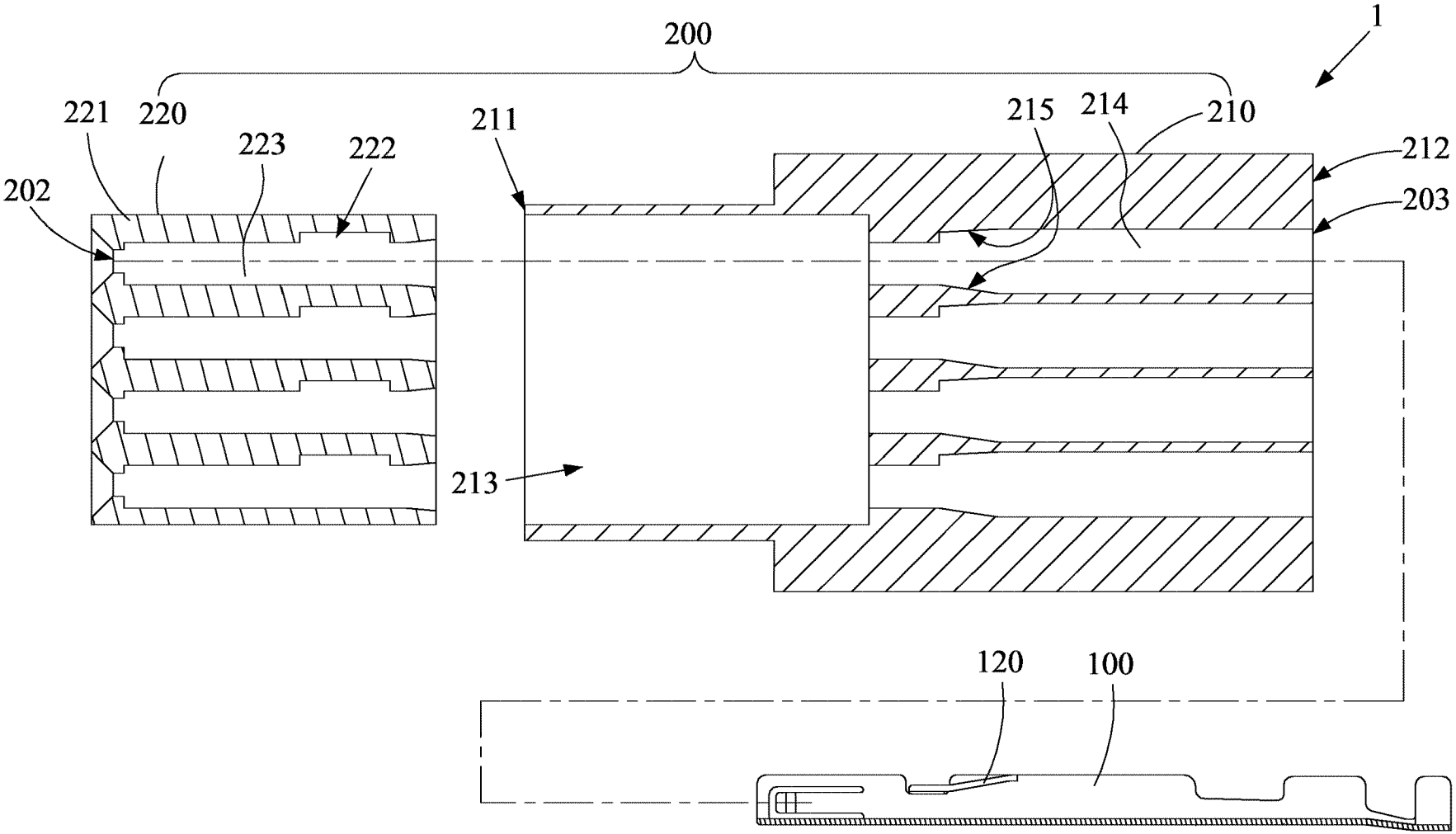
FIG. 10 illustrates an exploded cross-sectional view of an electrical connector according to a second embodiment of this disclosure.

Please refer to FIG. 10, illustrating a terminal pin 100 according to a second embodiment of this disclosure. The terminal pin 100 is adapted to be combined with a base 200 to form an electrical connector 1.

In the second embodiment, the notch 204 is formed at the wall surface of the second through hole 223, so that the stopping surface 205 is a portion of the wall surface of the second through hole 223. The position of the elastic latch 120 corresponds to the position of the notch 204. Therefore, when the first end 111 of the pin body 110 is abutted against the stopping flange 202*a* at the edge of the insertion opening 203, the elastic latch 120 can be just engaged into the notch 204.

Figure 11:
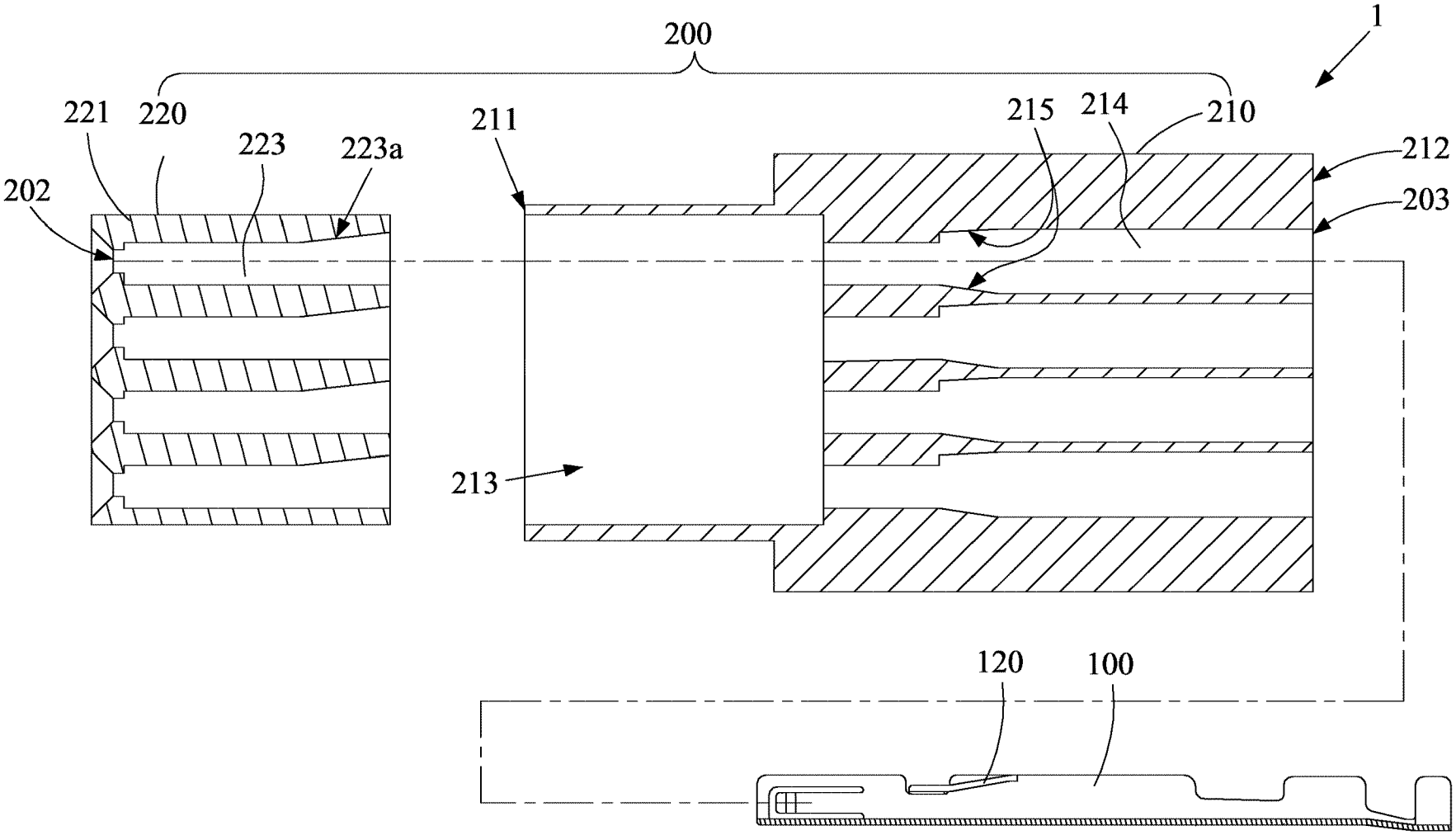
FIG. 11 illustrates an exploded cross-sectional view of an electrical connector according to a third embodiment of this disclosure.
Figure 12:
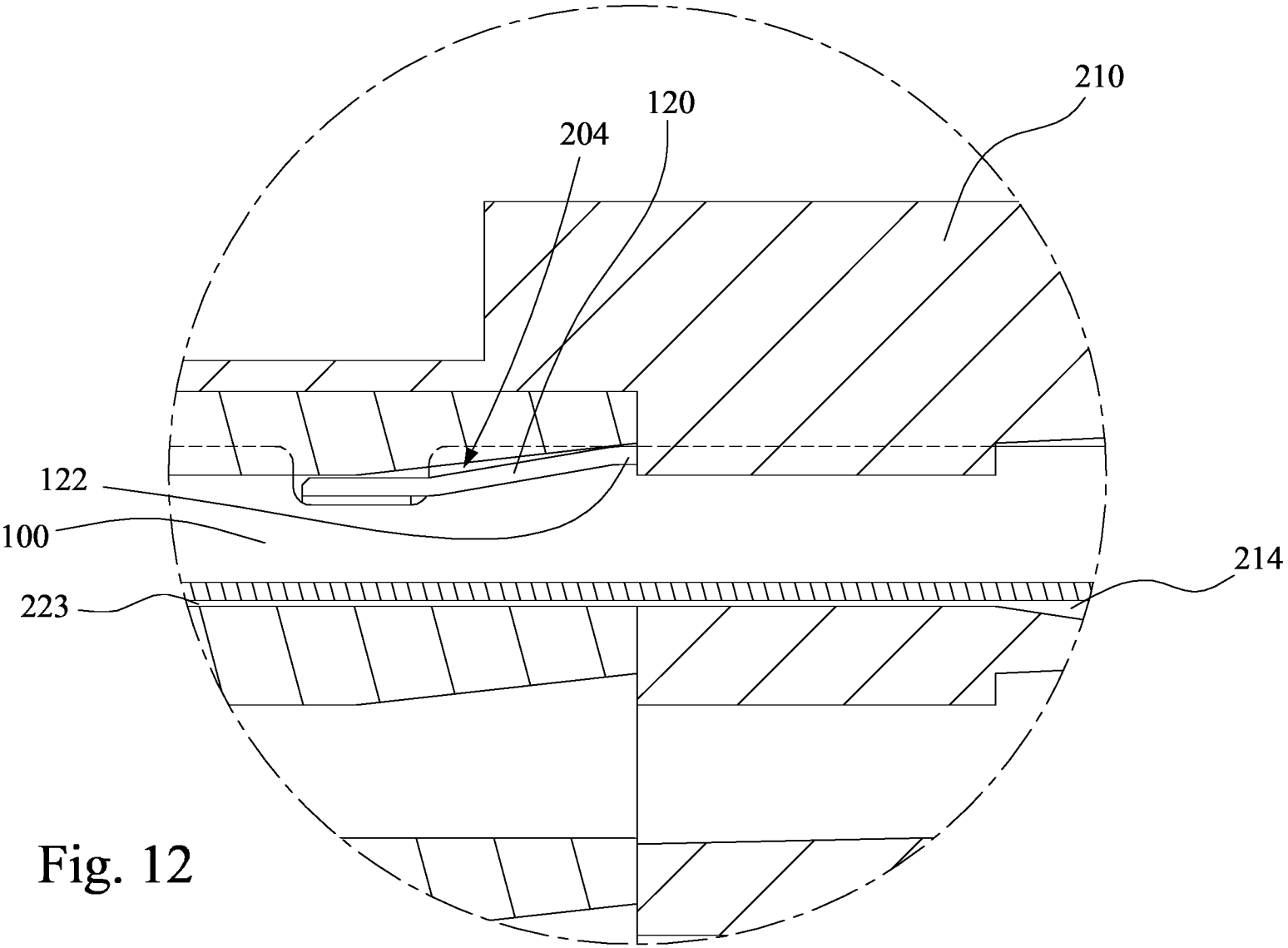
FIG. 12 illustrates a partial cross-sectional view of the electrical connector of the third embodiment.

Please refer to FIGS. 11 and 12, illustrating a terminal pin 100 according to a third embodiment of this disclosure. The terminal pin 100 is adapted to be combined with a base 200 to form an electrical connector 1.

In the third embodiment, at least one missing corner 223*a* is formed at one end of the second through hole 223 on the rear surface 222. The missing corner 223*a* can be rectangular or triangular.

As shown in FIGS. 11 and 12, when the first through hole 214 is connected to the second through hole 223, the missing corner 223*a* and a bottom of the installation trough 213 define the notch 204, and the stopping surface 205 is a portion of the bottom. The position of the elastic latch 120 corresponds to the position of the notch 204. Therefore, when the first end 111 of the pin body 110 is abutted against the stopping flange 202*a* at the edge of the insertion opening 203, the elastic latch 120 can be just engaged into the notch 204. The stopping tip 122 can be abutted against the bottom of the installation trough 213. That is, in this embodiment, the stopping tip 122 can be abutted against the stopping surface 205.

In one or more embodiments of this disclosure, the terminal pin 100 includes the elastic latch 120. The terminal pin 100 can be automatically engaged with the base 200 after being inserted into the base 200. Therefore, the electrical connector 1 can be devoid of external components, such as fixing pins, which are used for positioning the terminal pin 100, thereby reducing the assembly time of the electrical connector 1. In one or more embodiments of this disclosure, the electric connector 1 including the terminal pin 100 is further provided. The electrical connector 1 is provided with bases 200 in different structures, and the electrical connector 1 is provided with the notch 204 corresponding to the elastic latch 120 to fix the terminal pin 100.

What is claimed is:

1. A terminal pin, comprising:

a pin body, comprising:

a first end;

a second end;

a bottom wall:

two side walls extended upward from two sides of the bottom wall to form a structure with a C-shaped or U-shaped cross section having one side totally opened, and a slot is formed on each of the side walls, respectively, and a hollow space is defined among the bottom wall and two side walls; and two elastic clamping members disposed at the first end, wherein one end of the elastic clamping member is connected to a side peripheral wall of the slot, and the other end of the elastic clamping member is a free end and protrudes to the hollow space; and an elastic latch, connected to the pin body and normally protruding from the pin body with a stopping tip extending toward the second end, wherein a fixed end of the elastic latch is extended across the opened side of the C-shaped or U-shaped cross section from one of the two side walls, so that the elastic latch is located above the hollow space.

2. The terminal pin as claimed in claim 1, wherein the pin body includes a fixed portion disposed at the second end.

3. An electrical connector, comprising:

a base, including at least one accommodating aperture defined through the base to form a receiving opening and an insertion opening on the base; wherein a notch is formed in the at least one accommodating aperture, the notch is recessed from an inner wall of the at least one accommodating aperture, and the notch includes a stopping surface facing toward the receiving opening; and a terminal pin, including a pin body and an elastic latch; wherein the pin body includes a first end, a second end, a bottom wall, two side walls and two elastic clamping members; wherein two side walls extended upward from two sides of the bottom wall to form a structure with a C-shaped or U-shaped cross section having one side totally opened, and a slot is formed on each of the side walls, respectively, and a hollow space is defined among the bottom wall and two side walls: wherein two elastic clamping members disposed at the first end, wherein one end of the elastic clamping member is connected to a side peripheral wall of the slot, and the other end of the elastic clamping member is a free end and protrudes to the hollow space; wherein the elastic latch is connected to the pin body and normally protrudes from the pin body with a stopping tip extending toward the second end, and a fixed end of the elastic latch is extended across the opened side of the C-shaped or U-shaped cross section from one of the two side walls, so that the elastic latch is located above the hollow space; wherein the first end of the pin body passes through the insertion opening and is inserted into the at least one accommodating aperture, and the stopping tip of the elastic latch is abutted against the stopping surface.

4. The electrical connector as claimed in claim 3, wherein a stopping flange is formed at an edge of the receiving opening and extends inwardly along a radial direction of the second accommodating aperture.

5. The electrical connector as claimed in claim 3, wherein the base includes a first guiding bevel, the receiving opening includes a stepped segment with respect to a surface of the base, and the first guiding bevel connects the surface of the base to the edge of the receiving opening.

6. The electrical connector as claimed in claim 3, wherein a protruding rib is disposed in the accommodating aperture and extending along longitudinal direction of the accommodating aperture, and the concave portion hollow space is provided for receiving the at least one protruding rib.

7. The electrical connector as claimed in claim 6, wherein the at least one protruding rib corresponds to the notch.

8. An electrical connector, comprising:

a base, including at least one accommodating aperture defined through the base to form a receiving opening and an insertion opening on the base; wherein a notch is formed in the at least one accommodating aperture, the notch is recessed from an inner wall of the at least one accommodating aperture, and the notch includes a stopping surface facing toward the receiving opening, wherein the base comprising:

a base body, including a first side surface and a second side surface opposite to the first side surface, wherein an installation trough is formed on the first side surface, the base body further includes at least one first through hole, the at least one first through hole communicates with the second side surface and the installation trough, and the at least one first through hole forms the insertion opening at the second side surface; and a front cover, including a front surface and a rear surface, wherein the front surface further includes at least one second through hole communicating with the front surface and the rear surface, and second through hole forms the receiving opening at the front surface;

wherein the front cover is embedded into the installation trough with the rear surface facing the base body, so that the at least one second through hole is connected to the at least one first through hole to form the accommodating aperture; and a terminal pin, including a pin body and an elastic latch; wherein the pin body includes a first end and a second end, the elastic latch is connected to the pin body and normally protrudes from the pin body with a stopping tip extending toward the second end; wherein the first end of the pin body passes through the insertion opening and is inserted into the at least one accommodating aperture, and the stopping tip of the elastic latch is abutted against the stopping surface.

9. The electrical connector as claimed in claim 8, wherein the base further includes a second guiding bevel located in the first through hole, the second guiding bevel divides the first through hole into two sections, and a pore diameter of one of the two sections of the first through hole near the insertion opening is greater than a pore diameter of the other portion of the first through hole near the receiving opening.

10. The electrical connector as claimed in claim 9, wherein the notch is formed on a wall surface of the at least one second through hole, and the stopping surface is a portion of the wall surface of the at least one second through hole.

11. The electrical connector as claimed in claim 9, wherein the notch is formed on a wall surface of the at least one first through hole, and the stopping surface is a portion of the wall surface of the at least one first through hole.

12. The electrical connector as claimed in claim 9, wherein a missing corner is formed at one end the at least one second through hole on the rear surface, the missing corner and a bottom of the installation trough define the notch, and the stopping surface is a portion of the bottom.

* * * * *